US007794147B2

(12) United States Patent
Perelman

(10) Patent No.: US 7,794,147 B2
(45) Date of Patent: Sep. 14, 2010

(54) MULTIPLE APPLICATIONS OF SEAMING SOLUTIONS FOR HEAT SHRUNK BANDS AND LABELS

(75) Inventor: Alexander Perelman, Richmond, VA (US)

(73) Assignee: Reynolds Packaging LLC, Richmond, VA (US)

( * ) Notice: Subject to any disclaimer, the term of this patent is extended or adjusted under 35 U.S.C. 154(b) by 0 days.

(21) Appl. No.: 11/672,022

(22) Filed: Feb. 6, 2007

(65) Prior Publication Data

US 2008/0050543 A1 Feb. 28, 2008

Related U.S. Application Data

(60) Provisional application No. 60/823,584, filed on Aug. 25, 2006.

(51) Int. Cl.
*B65D 30/00* (2006.01)

(52) U.S. Cl. ..... 383/107; 383/207; 383/208; 383/210; 383/211

(58) Field of Classification Search ..... 383/107, 383/207, 208, 210, 211; 229/87.05
See application file for complete search history.

(56) References Cited

U.S. PATENT DOCUMENTS

| | | | | |
|---|---|---|---|---|
| 1,344,080 | A | 6/1920 | Galibert | |
| 1,827,636 | A | 10/1931 | Ames | |
| 2,307,280 | A | 1/1943 | Krasno | |
| 2,679,195 | A | 5/1954 | Whytlaw | |
| 2,847,340 | A | 8/1958 | Joosten | |
| 2,914,108 | A | 11/1959 | Coakley | |
| 2,926,723 | A | 3/1960 | Clark | |
| 3,005,742 | A | 10/1961 | Kennedy, Jr. | |
| 3,249,288 | A * | 5/1966 | Repko | 383/204 |
| 3,309,006 | A * | 3/1967 | Perry et al. | 383/100 |
| 3,570,751 | A * | 3/1971 | Trewella | 383/207 |
| 3,597,292 | A | 8/1971 | Takeda | |
| 3,873,018 | A | 3/1975 | Donnay | |
| 4,009,793 | A | 3/1977 | Minesinger et al. | |
| 4,035,211 | A | 7/1977 | Bill et al. | |
| 4,276,333 | A | 6/1981 | Cobean | |
| 4,363,843 | A | 12/1982 | Crofts | |
| 4,428,477 | A * | 1/1984 | Cristofolo | 206/210 |

(Continued)

OTHER PUBLICATIONS

EFD Brochure, "When you specify boringly reliable fluid dispense valve systems, you say "Good-bye" to costly downtime." pp. 1-4, 12-13, 24-25, 37-40, Printed in USA, © 2000 EFD, Inc.

*Primary Examiner*—Nathan J Newhouse
*Assistant Examiner*—Jack H Morgan, Jr.
(74) *Attorney, Agent, or Firm*—Greenberg Traurig LLP

(57) ABSTRACT

A sleeve and method for making the same for use in packaging consumer goods comprising a plastic film having a first longitudinal edge and a second longitudinal edge is disclosed. The plastic film is rolled into a tube wherein the first longitudinal edge overlaps the second longitudinal edge defining a flap. A plurality of seaming beads are applied along the first longitudinal edge to seam the first longitudinal edge to the second longitudinal edge, the plurality of seaming beads including an inner seaming bead and an outer seaming bead to form a plurality of seams in the sleeve. In exemplary embodiments, the plurality of seaming beads are utilized with different adhesive solutions. Other embodiments include, but are not limited to a perforation strip between the at least two seaming solutions.

8 Claims, 4 Drawing Sheets

U.S. PATENT DOCUMENTS 4,477,304 A 10/1984 Westermann
4,550,441 A * 10/1985 Keppel ..... 383/103
4,572,377 A * 2/1986 Beckett ..... 383/5
4,617,683 A 10/1986 Christoff
4,708,705 A 11/1987 Aubry et al.
4,735,668 A 4/1988 Hoffmann et al.
4,758,456 A 7/1988 Muscala
5,217,307 A 6/1993 McClintock
5,409,115 A * 4/1995 Barkhorn ..... 206/440
5,507,872 A 4/1996 Antenucci et al.
5,658,632 A 8/1997 Krabill
5,759,337 A 6/1998 Fujio et al.
6,238,509 B1 5/2001 Herifterkamp et al.
6,312,550 B1 11/2001 Tiburtius et al.
6,322,864 B1 * 11/2001 Fresnel ..... 428/34.9
6,485,803 B1 11/2002 Bright
6,902,639 B1 6/2005 Perelman et al.
7,074,295 B2 7/2006 Bellafore et al.

* cited by examiner

MULTIPLE APPLICATIONS OF SEAMING SOLUTIONS FOR HEAT SHRUNK BANDS AND LABELS

RELATED APPLICATION DATA

The present application claims priority from U.S. provisional patent application Ser. No. 60/823,584, filed Aug. 25, 2006, which is incorporated herein by reference.

BACKGROUND

1. Technical Field

The present disclosure relates to the field of packaging consumer goods with plastic tamper evident and freezer capable bands and labels. In particular, a plastic film having adhesively bonded seaming solutions on its overlapping edges to create a plastic sleeve and method of manufacture is disclosed. In exemplary embodiments, the edges of the plastic films are connected utilizing multiple seams and a tear away graspable flap is formed by excess film extending beyond the seams.

2. General Background

Sleeves of plastic films are created by folding a single web of plastic film into a tube and forming a seam at the overlapping edges of the plastic film. These sleeves are utilized to manufacture heat sealable bands and labels for packaging of consumer goods. Tamper evident bands and other heat shrunk labels are utilized in several different applications. For example, the bands may be utilized for packaging food, pharmaceuticals, cosmetics or other products.

The art of adhesively seaming heat shrinkable films to make bands, sleeves or labels is fairly well developed. The seams must meet certain manufacturing requirements as well as specific requirements of particular foods and containers. The bands must be manufactured with speed and efficiency, but also have the required strength, appearance, and reliability.

Many times the bands are heat sealed to the container to indicate the container and its contents have not been tampered with to a consumer. Thus, it is important to maintain a strong band that only breaks when a consumer wants to access the contents of the container.

Conventionally, the bands, labels, sleeves and other applications created by the plastic films can be perforated to allow the consumer to more easily break the seal by pealing away a perforation strip to obtain what is in the container. In many instances, the perforation strip is formed at a location on the band other than the seamed area and the seamed area is meant to remain intact. The band is meant to be broken only at these perforations.

Often the perforation will fail before reaching the consumer. For example, the perforation may be too deep or the holes may be close together due to manufacturing issues. Thus, the band may break during the heat shrinking process or due to stresses experienced during the shipping and handling of the product. Additionally, many food products are frozen. In frozen food applications, the band will freeze and the perforation has a greater likelihood of failing due to thermal stresses or changes in brittleness as the temperature varies.

Additionally, the perforation may be too tight, making it difficult for a consumer to break the seal. Sometimes the producer will not even use perforation because perforations fail, making opening the container more difficult. Thus, the consumer must use some sort of tool to open the band. This is especially difficult for consumers who are weak, or have arthritis or other medical conditions.

SUMMARY

In an exemplary embodiment, a sleeve for use in packaging consumer goods comprising a plastic film having a first longitudinal edge and a second longitudinal edge. The plastic film is formed into a tube wherein the first longitudinal edge overlaps the second longitudinal edge defining a flap. A plurality of seaming beads are applied along the first longitudinal edge to seam the first longitudinal edge to the second longitudinal edge, the plurality of seaming beads including an inner seaming bead and an outer seaming bead to form a plurality of seams.

The overlapping edges of the plastic film form a flap, the flap being held closely to the container by the plurality of seams.

In another embodiment, the inner seaming bead comprises a stronger seaming solution to form an inner seam and the outer seaming bead comprises a weaker seaming solution to form an outer seam. In an exemplary embodiment, the outer seam may be easily broken by the consumer to provide access to the flap. The flap may then be pulled in the horizontal direction to remove the sleeve. As a result, there is a convenient flap, with no special perforation requirements, that provides an easily removable tamper-evident label or band.

This may also provide a benefit to the recycling of the different materials. The container and label may be of different materials that are best recycled separately. An easily removable band or label would provide for more efficient recycling.

In other embodiments, the sleeve further comprises a perforation strip having a plurality of perforation holes or series of dashes wherein the thickness of the film is reduced or interrupted to enable a user to break the sleeve and access contents of a container. In particular embodiments, the perforation strip is located on the second longitudinal edge and is protected by the flap when sealed. The flap lies over the perforated area, preventing failure due to stresses during manufacture or handling of the product.

In exemplary embodiments, the sleeve comprises heat shrinkable materials. The sleeve is used as a label for a container or as a tamper resistant security band.

In a further embodiment, a method of forming a multiple seam at overlapped first and second longitudinal edge portions of a plastic film is disclosed, the method comprising the steps of first providing a supporting base, a plurality of dispensing valves each with a dispensing tip spaced closely to the circumferential surface of the applicator roll, two nip rolls downstream of the applicator roll, and at least one web of plastic film. Then the film would be moved longitudinally over the supporting base and then between the rotating nip rolls. At this point, through the plurality of valves and tips, a plurality of continuous beads or spaced apart drops of an adhesive would be dispensed, and at least an inner seaming bead and an outer seaming bead are laid onto the first edge portion of the film while the film is supported by the supporting base.

In another embodiment, the method comprises overlapping the second edge portion onto the first edge portion, with the plurality of seaming beads of adhesive between the two overlapped edge portions. Then the overlapped edge portions are squeezed between the nip rolls, whereby the adhesives exude laterally outward from the channel and each bead is distributed smoothly between the overlapped edge portions, until the adhesives and dissolved film form a plurality of uniform bands.

DRAWINGS

The foregoing aspects and advantages of the present disclosure will become more readily apparent and understood with reference to the following detailed description, when taken in conjunction with the accompanying drawings, wherein.

DETAILED DESCRIPTION

A sleeve for use in packaging consumer goods is disclosed. In exemplary embodiments, the sleeve comprises a plastic film having a first longitudinal edge and a second longitudinal edge, the plastic film being rolled into a tube wherein the first longitudinal edge overlaps the second longitudinal edge. The overlapped edges define a flap that is sealed together with a plurality of seaming beads applied along the first longitudinal edge to seam the first longitudinal edge to the second longitudinal edge.

In an exemplary embodiments, the plurality of seaming beads will contain an inner and outer seaming bead. In this embodiment, the sleeve will include at least two seaming solutions and seams. However, the sleeve may also comprise additional seams and seaming solutions as needed.

A conventional tube forming machine is used to create the sleeve. In exemplary embodiments, the seaming beads may comprise any adhesive or glue.

In a further embodiment, the overlapping edge portions 42, 44 form a lengthy flap 104. The flap 104 is securely attached to the second edge portion 44 by the outer seaming bead 46. This helps to prevent the flap 104 from catching on something during production or shipping of a product and causing a label or security band to break.

Figure 1:
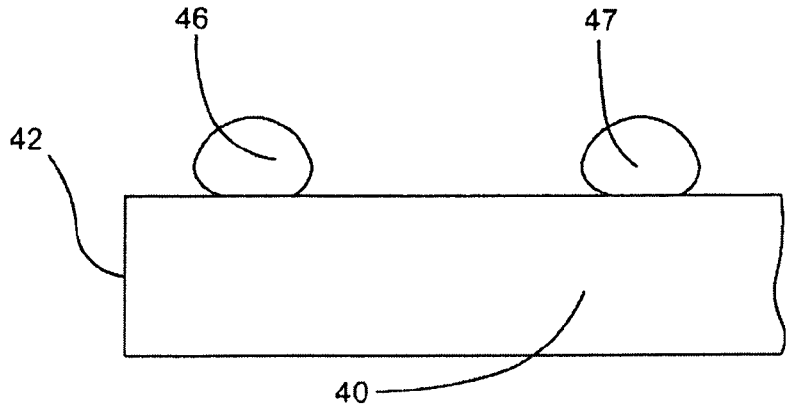
FIG. 1 illustrates one edge portion of plastic film wherein a plurality of adhesive beads has been applied according to the present invention.

FIG. 1 illustrates one embodiment of the plastic film 40 after an application of the two adhesive beads 46, 47 have been placed on one edge portion 42. The multiple seaming beads 46, 47 may comprise different solvent based seaming solutions. In an exemplary embodiment, the outer seaming bead 46 comprises a weaker seaming solution and the inner seaming bead 47 comprises a stronger seaming solution.

Figure 2:
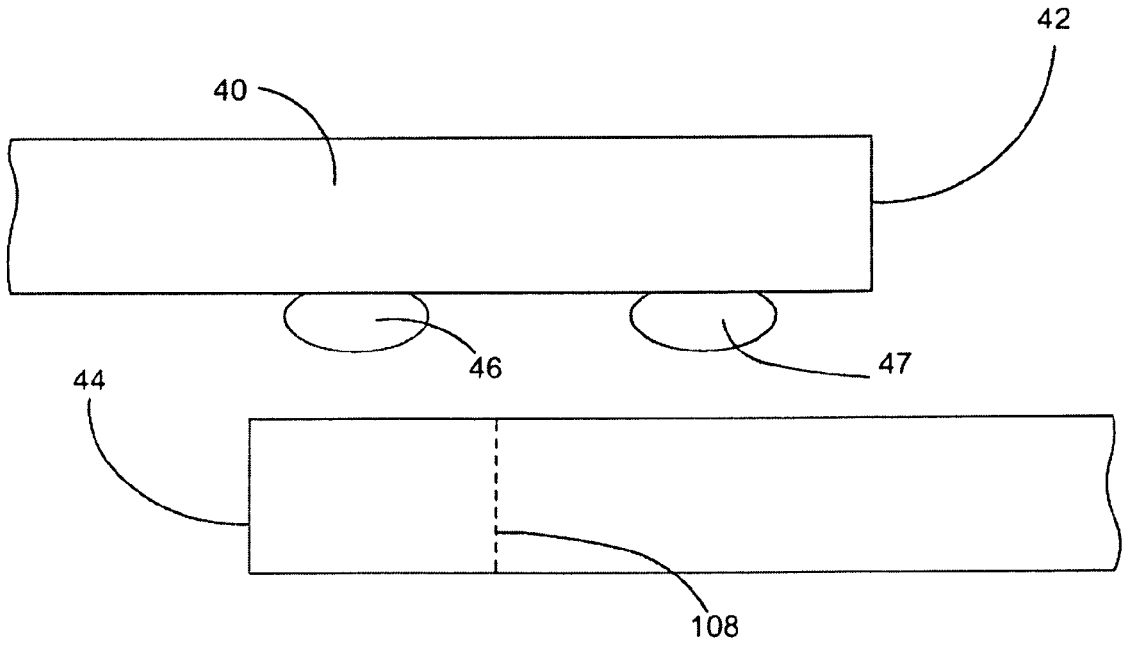
FIG. 2 illustrates the overlapping edge portions of the film and the plurality of adhesive beads before the film has been pressed together to form a sleeve.

FIG. 2 illustrates this edge portion 42 later, just after film 40 has been folded into a tube with edge portions 42, 44 overlapping, and the two beads of adhesive 46 and 47 are about to contact second longitudinal edge portion 44.

Figure 3:
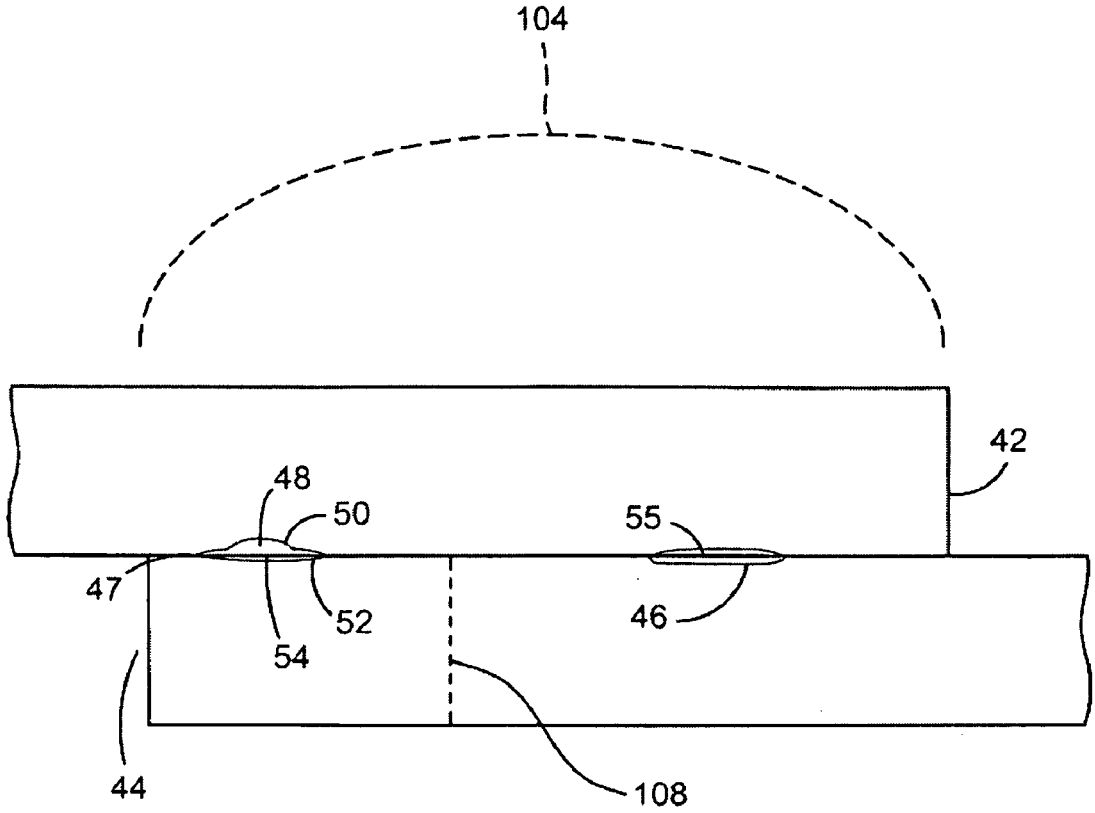
FIG. 3 illustrates a section of the formed sleeve, showing the overlapping edge portions of the plastic film and the plurality of adhesive beads according to the present invention.

FIG. 3 shows film edge portions 42, 44 and adhesive 46, 47 just after they have been pressed together to form a seam. In particular embodiments, the inner adhesive bead 47 has a rounded hat-shape cross-sectional profile, with a crown 50 and brim 52. The crown 50 occupies respective channels 48 and brims 52 lie along the interface between edge portions 42 and 44. A line 54 indicates the original position of the surface of edge portion 42. In exemplary embodiments, the outer seam 46 lies flat on the surface of the overlapping edges of the film making a weaker seam. A line 55 indicates the original position of the surface of edge portion 42.

A flap 104 defined by the overlapping edge portions 42, 44 of the sleeve is provided. The flap 104 is held close to the container by the outer seaming bead 46. By resting flat against the overlapping edge 44 of the band, the flap 104 does not cause interference with wrapping or packaging equipment.

Figure 4:
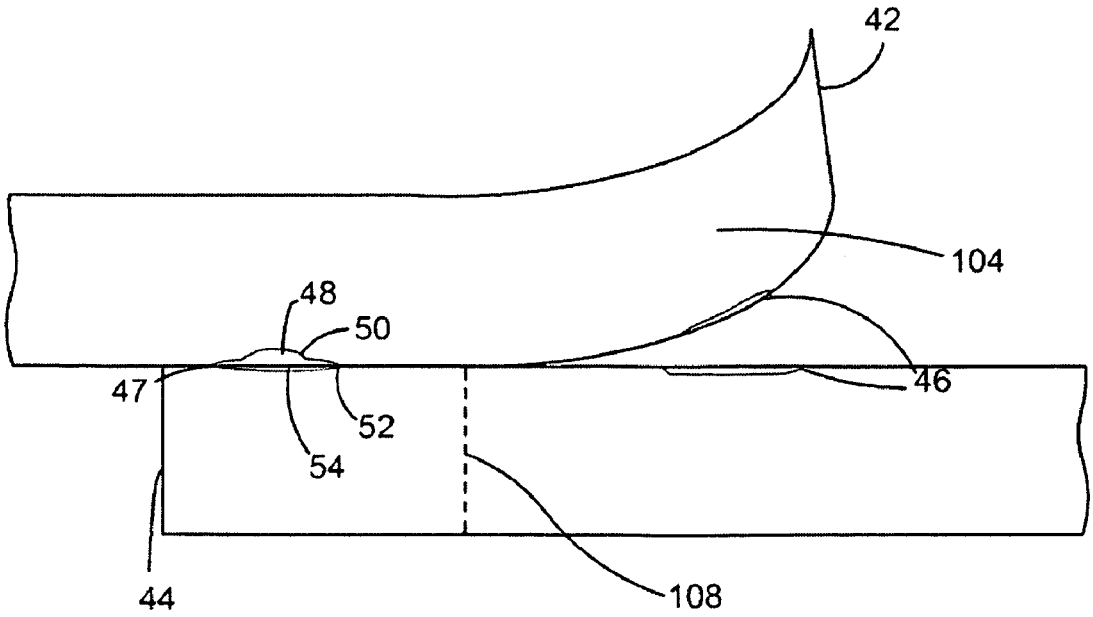
FIG. 4 illustrates a section of the formed sleeve, the weaker outer seaming bead being broken to provide a long gripping flap for a consumer to break the sleeve.
Figure 5:
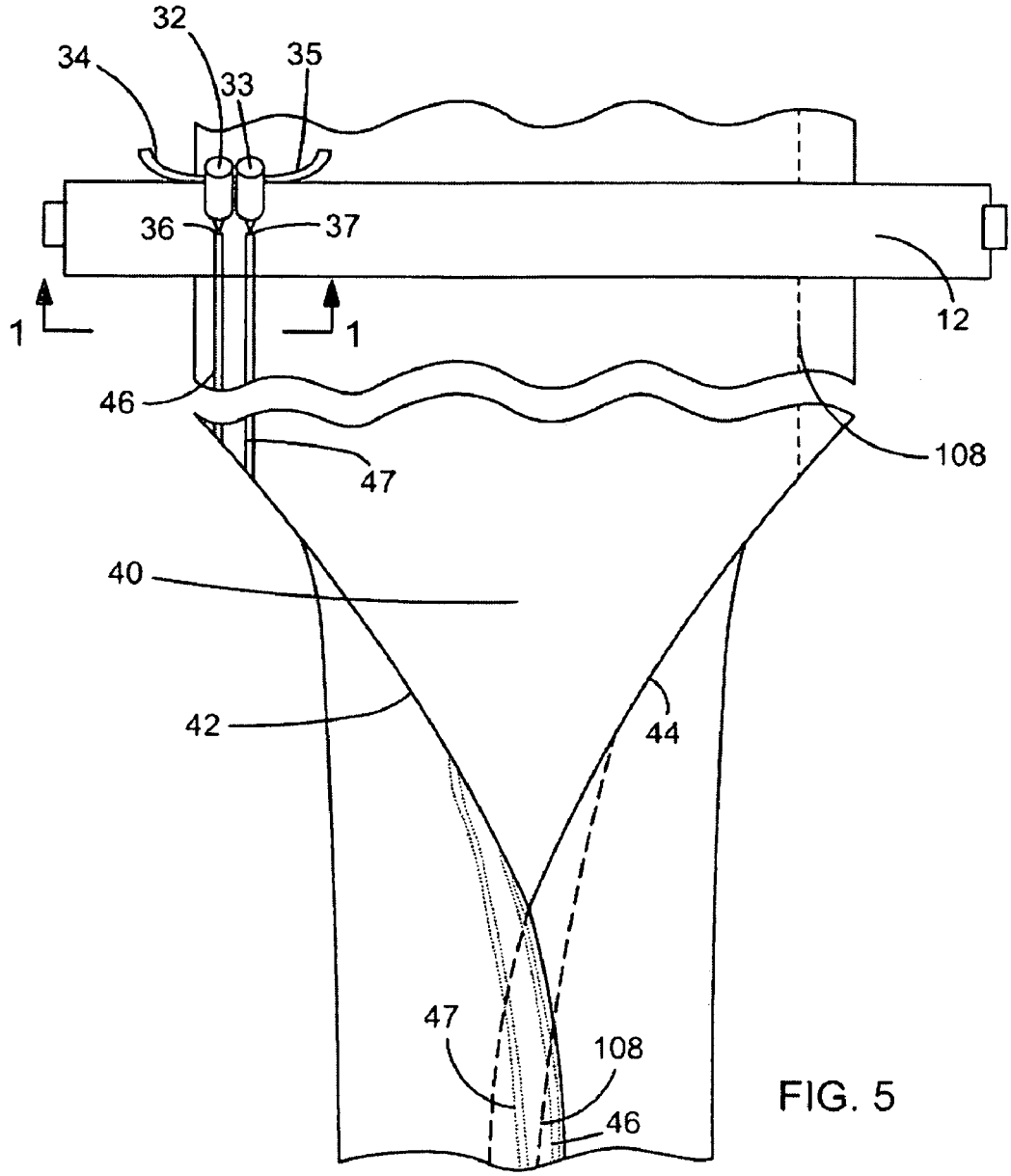
FIG. 5 is a schematic plan view of an applicator roll, a dispensing valve and tip, and film having adhesive applied to it and being formed into a tube.
Figure 6:
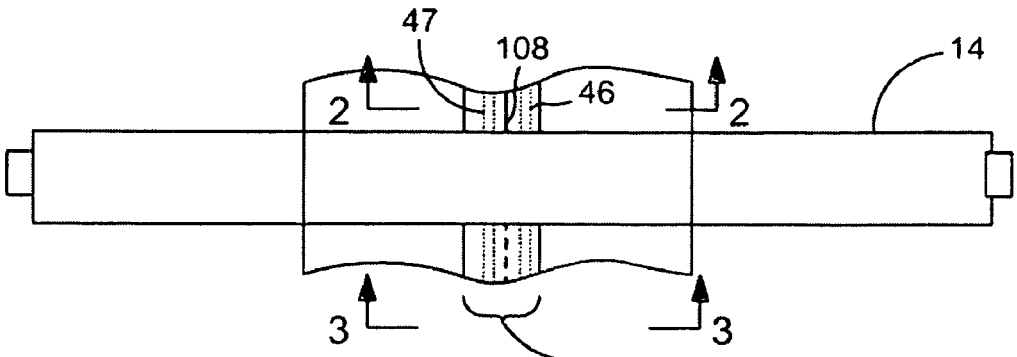
FIG. 6 is a schematic plan view of the nip rolls with the film and adhesive passing between them.

In exemplary embodiments, to break this seal or label disclosed herein, the consumer lifts up the flap 104 and breaks the weaker seaming joint formed with the outer seaming bead 46 as illustrated in FIG. 4. Thus, the consumer is provided with the a gripping flap 104 to facilitate sleeve removal. The flap 104 as it is pulled away from its location adjacent the opposing edge 44 of the sleeve. The outer seaming bead 46 is broken into two portions, one portion of the outer seaming bead staying attached to each of the overlapping edges 42, 44. The consumer can then pull this long gripping flap 104 in a direction towards the inner seam 47 to break the inner seam 47 and thereby remove the sleeve from the container.

Breaking the band or label in this way is a much more natural way to break the away the band for the consumer. A consumer is able to pull the band in the horizontal direction, or shrink direction, instead of the machine, or vertical direction required by conventional tamper resistant bands. This provides easier access to containers for weak, disabled or older people who may have trouble opening the band by conventional means.

In another exemplary embodiment, the plastic film 40 may also contain a perforation strip 108. The perforation strip may comprise a plurality of perforation holes. In other embodiments, the perforation strip comprises a series of indentions into the film wherein the thickness of the plastic film is reduced but not broken, thereby weakening the film to form the perforation strip. Other means of creating a perforation strip may be utilized. Prior to placement of the adhesives onto the plastic film, a perforation strip is placed into the strip on the opposing end portion 44 from where the adhesives will be placed. In one embodiment, after the plastic film has been rolled into a tube, the perforation strip is under the large flap 104 created by the overlapping edge portions 42, 44 of the plastic film between the plurality of seaming beads 46, 47.

In this embodiment, the perforation strip 108 may be placed between the two seaming solutions 46, 47. By placing the perforation strip under the flap 104 between the two seaming solutions, the perforation is protected during the shipping and handling of consumer products or storing in special conditions. For example, when stored at very high or low temperatures, the perforation may break. As a result of placing the perforation strip 108 under the flap 104, the perforation will not fail, and the sleeve will maintain its tamper evident capabilities, while also providing a useable perforation to the individual user.

To open the sleeve in this embodiment, the weaker seaming joint formed with the outer seaming bead 46 may be broken pulling away and releasing the flap 104 from its location flat against the surface of a container. Then, the perforation 108 may be broken taking the seal or label off of the container.

The container and label or security band may be made of dissimilar materials or plastics. Since they are made of dissimilar materials, the container and label are best recycled separately. By providing an easily removable band or label, the container and label may be separated more efficiently. As a result, recycling of the container and label is much more efficient.

To manufacture the band or label, any existing methods to seam a flat strip of film in the tube or to join separate strips may be utilized. These methods include contact applications, for example but not limited: ultrasonic horn, wick, applying wheels (straight or satellite, with plain applying face or gravure), mapping flow-seal valve and others. Other non-contact application may occur wherein the applicator does not have direct contact with the films, whereas in some cases the applying tube creates pressure against the web. The adhesive solution could be applied based on gravity or by pressure. Other conventional means of manufacturing a sleeve may also be utilized to manufacture the disclosed sleeve. It would be obvious for one skilled in the art to modify any existing method of manufacture to produce the sleeve connected utilizing multiple seams and having a tear away graspable flap formed by excess film (overlapping edges) extending beyond the seams.

Figure 7:
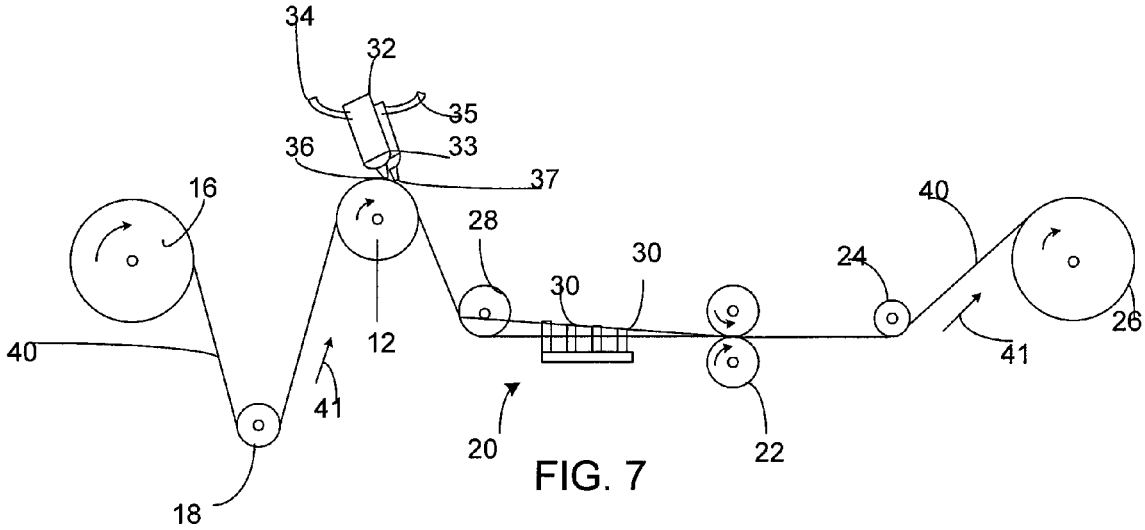
FIG. 7 is a schematic elevation view of an unwind roll, an applicator roll, a dispensing valve and tip, a folding mechanism, nip rolls, and a rewind roll.
Figure 8:
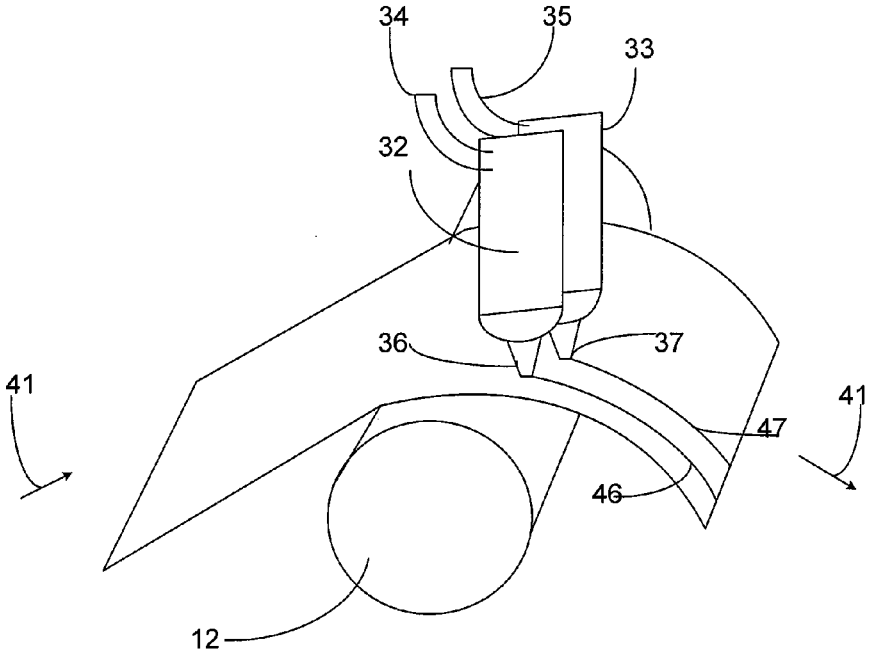
FIG. 8 is a schematic detail view of the applicator roll and the dispensing valve and tip shown in FIG. 7.

For purposes of illustrations, FIG. 5 through FIG. 8 show one exemplary embodiment of a system that may be utilized to produce the sleeve disclosed herein. This system is only provided as an example, and the above and other methods of manufacture may also be utilized. This exemplary system has a supporting base 12 and nip rolls 14 of a tube forming and seaming machine. In exemplary embodiments, the support base may be applicator roll that rotates. However, in other embodiments, the base may be flat or any other possible way to allow a adhesive to placed on a roll. As shown in FIG. 7, the machine comprises, going from upstream to downstream, film unwind roll 16, tracking mechanism 18, folding mechanism 20, nip rolls 22, tension control idler 24, and rewind roll 26. The folding mechanism 20 includes roller 28 which is rounded at its opposite ends and felt strips which form a series of adjustable loops 30 that diminish in circumference. The apparatus described thus far in this paragraph is conventional.

In an exemplary embodiment, the seaming machine includes a first dispensing valve 32 connected to fist adhesive delivery line 34 and replaceable hollow, tubular first tip 36 is mounted at an angle with respect to applicator roll 12, with the first tip spaced closely to the circumferential surface of applicator roll 12. In a further embodiment, the seaming machine includes a second dispensing valve 33 connected to fist adhesive delivery line 35 and replaceable hollow, tubular second tip 37 is mounted at an angle that may be similar or different with respect to applicator roll 12. Again, the second tip is spaced closely to the circumferential surface of applicator roll 12.

The valves 32 and 33 are mounted so that this space may be adjusted by moving the valves forward, backward, or sideways. The angle of the valves and tips with respect to the circumferential surface of the roll may also be adjusted. The inner diameter of tip 36 is typically from about 0.003 inch to about 0.005 inch. It may be as large as about 0.010 inch. The dispensing valves and tips, considered apart from the other apparatus described, are conventional.

The film 40 is unwound from unwind roll 16 and proceeds in the direction of arrows 41. The unwind roll 16 may be part of an unwind station (not shown) which permits new rolls to be substituted for spent rolls without manually attaching the two webs together. In some embodiments, the plastic film may have a perforation strip on one edge of the plastic film.

The plastic film 40 proceeds over tracking mechanism 18, which aligns the film, and then over applicator roll 12, where a first bead of adhesive 46 passes through the first valve 32 and first tip 36 and a second bead of adhesive 47 passes through the second valve 33 and is laid down on the surface of film 40, which is supported by applicator roll 12. The adhesives is forced through valves 32 and 33 and tips 36 and 37 by the pressure exerted on it in a pressure tank (not shown) containing nitrogen or clean air, which tank is connected to inlet line 34 and to a remote pressure source through appropriate valving. In exemplary embodiments, the tips are spaced 0.005 inches from film 40, but this distance may vary from about 0.001 inch to about 0.010 inch, depending upon the specific adhesive used, the width of the adhesive band desired to be laid down to make a particular seam, and the configuration and inner diameter of the tip. The film 40 then proceeds to conventional folding mechanism 20, where it is folded into a tube with its opposite longitudinal edge portions overlapping. Next, the film 40 passes between nip rolls 14, where the two edge portions are squeezed together to create the seam. Finally, the film 40 passes over tension control idler 24 and onto rewind roll 26. A rewind roll 26 may be part of a rewind station (not shown) which permits empty rolls to be substituted for full rolls, without manual attachment of a cut film edge to an empty roll core.

The rapid transition between FIGS. 2 and 3, which occurs just prior to the nip rolls and in the nip of the nip rolls, is important. As film edge portions 42, 44 are being progressively squeezed by the nip rolls, the adhesives 46, 47 are progressively exuded laterally into the interface.

The channel 48 in the inner seaming bead 47 is a critical factor in creating a strong seam of precisely and neatly placed adhesive. This may be due to the channel confining the adhesive bead so that it is not displaced laterally during the movement of the film as it is being handled between the applicator roll and the rip roll. Another possibility is that the channel increases the stability of the bead during its compression by the nip rolls, by reducing its effective height. Another possibility is that the channel increases the stability of the bead during such compression because of the increased surface contact provided by the channel. Another possibility is that during compression the body of adhesive material in the channel acts as a "reservoir" of adhesive which, when exuded from the channel, is "metered out" laterally into the interface more gradually than it would have been in the absence of a channel. Another possibility which takes into account flow of the adhesive ahead of the rip rolls in the longitudinal direction (i.e., toward a viewer of FIG. 3 and toward rewind roll 26 in FIG. 8) is that the channel acts as a guide for such forwardly flowing adhesive which has been partially, but not completely, squeezed by the rip rolls.

In an exemplary embodiment, the heat shrinkable materials disclosed herein may be utilized as a heat shrunk taper proof band to seal packaging containers or as labels for consumer products. The packaging containers may contain a variety of consumer goods, including foods, chemicals, cosmetics, pharmaceuticals, as well as other typical consumer products.

While the above description contains many particulars, these should not be considered limitations on the scope of the disclosure, but rather a demonstration of embodiments thereof. For example, the multiple seaming application and process disclosed herein may include any combination of the different species or embodiments disclosed. Accordingly, it is not intended that the scope of the disclosure be limited in any way by the above description. The various elements of the claims and claims themselves may be combined in any combination, in accordance with the teachings of the present disclosure, which includes the claims.

The invention claimed is:

1. A sleeve for use in packaging consumer goods comprising:

a plastic film, the plastic film having a first longitudinal edge region and a second longitudinal edge region, the plastic film being rolled into a tube wherein the first longitudinal edge region overlaps the second longitudinal edge region, the first and second longitudinal edge regions each having opposed inwardly facing and outwardly facing surfaces, such that the inwardly facing surface of the first longitudinal edge region is disposed in juxtaposed relation to the outwardly facing surface of the second longitudinal edge region;

the first longitudinal edge region including a first free edge and the second longitudinal edge region including a second free edge, the first and second free edges defining an overlap region therebetween;

a flap defined by the portion of the first longitudinal edge region that overlaps the second longitudinal edge region; and a plurality of seaming beads applied along the first longitudinal edge region to seam the inwardly facing surface of the first longitudinal edge region to the outwardly facing surface of the second longitudinal edge region, the plurality of seaming beads including at least an outer seaming bead forming an outer seam and an inner seaming bead forming an inner seam, the plurality of seaming beads comprising any glue or adhesive, wherein the outer and inner seaming beads are disposed in a parallel, laterally spaced apart relation to one another, the plurality of seaming beads being disposed between the first and second free edges, in the overlap region, the outer seam being weaker than the inner seam.

2. The sleeve of claim 1 wherein inner seaming bead comprises a stronger seaming solution to form the inner seam and the outer seaming bead comprises a weaker seaming solution to form the outer seam.

3. The sleeve of claim 2 wherein the outer seam may be easily broken by the consumer to provide a flap that may be pulled in the horizontal direction to remove the sleeve.

4. The sleeve of claim 1 further comprising a perforation strip having a plurality of perforation holes or a series of dashes wherein the thickness of the film is reduced to enable a user to break the sleeve and access contents of a container.

5. A sleeve for use in packaging consumer goods comprising:

a plastic film, the plastic film having a first longitudinal edge region and a second longitudinal edge region, the plastic film being rolled into a tube wherein the first longitudinal edge region overlaps the second longitudinal edge region;

a flay defined by the portion of the first longitudinal edge region that overlaps the second longitudinal edge region; and a plurality of seaming beads applied along the first longitudinal edge region to seam the first longitudinal edge region to the second longitudinal edge region, the plurality of seaming beads including at least an inner seaming bead and an outer seaming bead to form a plurality of seams, a perforation strip having a plurality of perforation holes or a series of dashes wherein the thickness of the film is reduced to enable a user to break the sleeve and access contents of a container;

wherein the perforation strip is located on the second longitudinal edge region and is protected by the flap when sealed.

6. The sleeve of claim 1 wherein the sleeve comprises heat shrinkable materials.

7. The sleeve of claim 1 wherein the sleeve is a label for a container.

8. The sleeve of claim 1 wherein the sleeve is a tamper resistant security band.

* * * * *

UNITED STATES PATENT AND TRADEMARK OFFICE

CERTIFICATE OF CORRECTION

PATENT NO. : 7,794,147 B2
APPLICATION NO. : 11/672022
DATED : September 14, 2010
INVENTOR(S) : Perelman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 103 days.

Signed and Sealed this
Fifteenth Day of March, 2011

David J. Kappos

David J. Kappos
*Director of the United States Patent and Trademark Office*